US009562318B2

(12) United States Patent
Youn

(10) Patent No.: US 9,562,318 B2
(45) Date of Patent: Feb. 7, 2017

(54) METHOD FOR DECOLORIZING A DENIM FABRIC USING OZONE

(71) Applicant: Kevin Jin Youn, Paramount, CA (US)

(72) Inventor: Kevin Jin Youn, Paramount, CA (US)

( * ) Notice: Subject to any disclaimer, the term of this patent is extended or adjusted under 35 U.S.C. 154(b) by 857 days.

(21) Appl. No.: 13/746,144

(22) Filed: Jan. 21, 2013

(65) Prior Publication Data

US 2014/0068871 A1 Mar. 13, 2014

Related U.S. Application Data

(60) Provisional application No. 61/698,554, filed on Sep. 7, 2012.

(51) Int. Cl.

| | |
|---|---|
| ***D06L 3/04*** | (2006.01) |
| ***D06L 1/14*** | (2006.01) |
| ***D06P 5/13*** | (2006.01) |
| ***D06P 5/15*** | (2006.01) |

(52) U.S. Cl.

CPC . *D06L 3/04* (2013.01); *D06L 1/14* (2013.01); *D06P 5/132* (2013.01); *D06P 5/153* (2013.01)

(58) Field of Classification Search

CPC ..... D06L 3/02; D06L 3/04; D06L 3/08

USPC ..... 8/101, 102, 109, 111, 115.51, 133, 137, 8/918

See application file for complete search history.

(56) References Cited

U.S. PATENT DOCUMENTS 5,261,925 A * 11/1993 Wasinger ..... D06B 11/0096 8/101
5,376,143 A * 12/1994 Wasinger ..... D06B 11/0096 8/101
5,613,983 A * 3/1997 Terry ..... D06B 11/0096 8/102
5,656,246 A * 8/1997 Patapoff ..... A61L 2/202 422/110
6,006,387 A * 12/1999 Cooper ..... A61L 2/202 68/13 R
6,024,766 A * 2/2000 Wasinger ..... D06L 3/061 8/101
7,252,688 B2 * 8/2007 Tashiro et al. ..... 68/5 C

OTHER PUBLICATIONS

Make Your Own Laundry Color Catcher, Aug. 15, 2012.*

* cited by examiner

*Primary Examiner* — Gregory R Delcotto
*Assistant Examiner* — Preeti Kumar
(74) *Attorney, Agent, or Firm* — East West Law Group; Heedong Chae

(57) ABSTRACT

This invention relates to a method for decolorizing a dyed denim fabric through a dry ozone process to obtain an aesthetically pleasing decolorized look or fashionably faded look in the denim fabric. The method comprises three dry ozone treatment processes used alone or in combination thereof. The first dry ozone treatment process includes wetting a denim textile product with water and oxidizing it with ozone. The second dry ozone treatment process includes spraying water to desired areas of the textile product and oxidizing it with ozone. The third dry ozone treatment process includes loading the denim textile product and wetted cotton fabric scraps into a drum, and oxidizing them with ozone.

8 Claims, 4 Drawing Sheets

METHOD FOR DECOLORIZING A DENIM FABRIC USING OZONE

CROSS-REFERENCE TO RELATED APPLICATIONS

This application claims the benefit of U.S. Provisional Application No. 61/698,554, filed Sep. 7, 2012, the entirety of which is incorporated herein by reference.

FIELD OF THE INVENTION

The present invention relates to a method for decolorizing a denim fabric using ozone. More particularly, this invention relates to a method for decolorizing a dyed denim fabric through a dry ozone process to obtain an aesthetically pleasing decolorized look or fashionably faded look in the denim fabric.

BACKGROUND OF THE INVENTION

Denim fabric has been decolorized to produce an aesthetically pleasing decolorized look or fashionably faded look. Two major means used for such decolorization are stones and bleaches. Stones such as pumice stones are used to create a used and abused appearance in denim fabric through a physical washing of the denim fabric with stones or rocks having an abrasive surface. Alternatively, bleaches such as potassium permanganate, peroxide, or hypochlorite are used with or without stones to decolorize or discolorize the surface of denim fabric.

FIG. 1 shows a conventional fabric decolorization method which comprises a dry process S110, a desize process S120, an optional resin process S130, an abrasion process S140, a decolorization process S150, a local decolorization process S160 and a finish process S170.

Dry process S110 is first performed on garments to achieve used or worn out look, and the dry process includes hand sand, whisker, grinding and laser operation. After the dry process S110, the desize process S120 is conducted to remove starch from the raw fabric. In this process S120, enzymes such as amylase enzyme, lubricant and/or wetting may be applied to the fabric and then, the fabric is rinsed. After the desize process S120, the resin process S130 may or may not be performed. The resin process S130 is to achieve three dimensional rigid look in the fabric and can be done by the processes of resin dip or spray, dry and resin cure.

Then, the abrasion process S140 is conducted on the fabric using stone, superstone (like sand), and/or neutral enzyme. Then, the fabric is rinsed and dried. After the abrasion process S140, the decolorization process S150 and the local decolorization process S160 are conducted on the fabric. The decolorization process S150 is performed on the overall areas of the garments whereas the local decolorization process S160 is conducted on desired areas of the garments. Bleach or potassium permanganate is applied and then, the garments are neutralized using chemicals such as sodium meta bisulfate.

Pumice stones are widely used for the abrasion process and adding pumice stones gives the additional effect of a faded or worn look, especially at the seam allowance or on stitches. The pumice abrades the surface of the garments like sandpaper, removing some dye particles from the surfaces of the yarn.

Bleaching gives garments a more used look and brighter complexion and is usually carried out by strong oxidizing agents such as potassium permanganate, hypochlorite, or peroxide. Bleaching may be performed on the garments in overall or selectively using a spray. Oxidation has to be followed by neutralization because the remaining bleach will keep on damaging the fabric.

Lastly, the finish process S170 is performed. Pocket white, softener and/or tint may be applied to the garments. Laccase enzyme may be used for a special effect and rewashing with bleach or potassium permanganate followed by neutralization may be optionally conducted.

While the denim garments are decolorized, high quantities of indigo dye are separated and they soil weft threads, inside pockets as well as labels. To prevent this backstaining, pocket white is used to separate indigo. Pocket white may be applied in every treatment phase on the denim fabric. The application of pocket white during stone washing or separate after-washing leads to a reduction of the backstaining.

A number of problems have been presented by the use of stones and/or bleaches. First, the use of stones creates a considerable amount of damage to the denim products and the machine used for the stone washing process and a lot of time and labor have to be spent to remove stones and rocks in pockets, creases, and interior folds of the garment and in the machine. All the suspended solid of stone debris goes down to the wastewater and this makes it more costly to dump the wastewater to the sanitation system. Furthermore, the stone abrasion process is not selective and everything in the machines gets abraded whether it's a garment, a metal button or a rivet on the garments. This significantly reduces the quality of the garments.

Besides, use of bleach or potassium permanganate requires the neutralization process because the remaining bleach or oxidative will continue to damage the garments and affect the shade and color of the garments. Additionally, the use of bleach or potassium permanganate may cause environmental problems by increasing suspended solids and chemical oxygen demand in wastewater as well as the volume of wastewater itself. These increases will lead to increased time and cost to treat wastewater because suspended solids in wastewater always have to be treated and environmental regulations have put severe stress on the textile industry to control pollution by wastewater treatment and disposing of the used pumice stones.

For the case of decolorizing t-shirts, there are several ways to dye t-shirts: direct dyeing, pigment dyeing, sulfur dyeing and reactive dyeing. Reactive dyeing uses a chemical reaction to dye a t-shirt. Stones or bleaches may be used to decolorize t-shirts if they are dyed by direct dyeing or pigment dyeing. Even if reactive dyeing produces vibrant colors of a t-shirt, there is no conventional way to decolorize t-shirts with reactive dyeing.

Accordingly, to solve the above problems, a need for a method for decolorizing a dyed denim fabric through a dry ozone process to obtain an aesthetically pleasing decolorized look or fashionably faded look in the denim fabric has been present for a long time considering the expansive demands in the everyday life. This invention is directed to solve these problems and satisfy the long-felt need.

SUMMARY OF THE INVENTION

The present invention contrives to solve the disadvantages of the prior art.

An object of the invention is to provide a method for decolorizing a dyed denim fabric through a dry ozone process to obtain an aesthetically pleasing decolorized look or fashionably faded look in the denim fabric.

Another object of the invention is to provide three dry ozone treatment processes used alone or in combination thereof for decolorizing a dyed denim fabric to obtain an aesthetically pleasing decolorized look or fashionably faded look in the denim fabric. The three dry ozone treatment processes dispense with the need to use stones and bleaches such as pumice stones or potassium permanganate. Furthermore, pocket white does not have to be used, either. With the three processes in use, stone washing, bleach washing and bleach spraying processes are not necessary, but the same or better decolorized look or faded look of garments can be achieved by using the processes.

The first dry ozone treatment process includes wetting a denim textile product with water, removing excess water from the water-soaked denim textile product, and exposing the denim textile product to the ozone gas for decolorizing the textile product. The second dry ozone treatment process includes spraying water to desired areas of the denim textile product and exposing the denim textile product to ozone gas to decolorize the textile product. Lastly, the third dry ozone treatment process includes loading the denim textile product and cotton fabric scraps into a drum wherein the cotton fabric scraps are wetted with water, supplying and stirring ozone gas inside the drum, and rotating the air-tight drum. The three dry ozone treatment processes may be applied alone or in any combination thereof.

Still another object of the invention is to provide the three dry ozone treatment processes used alone or in combination thereof for decolorizing a dyed t-shirts fabric to obtain an aesthetically pleasing decolorized look or fashionably faded look in the t-shirts fabric. There was no conventional way to dye t-shirts with reactive dying, but the three dry ozone treatment processes can achieve aesthetic decolorization effects even for t-shirts with reactive dying. Preferably, the third dry ozone treatment process can achieve decolorization of t-shirts, especially at the hems.

The advantages of the present invention are: (1) the dry ozone treatment processes of this invention dispense with the need to use stones and bleaches such as pumice stones or potassium permanganate, and thus they do not create damages to the garments or machine, but improve the quality of the garments; (2) the dry ozone treatment processes of this invention reduce fabric treatment time and labor; (3) the dry ozone treatment processes of this invention can create better and more varied aesthetically pleasing decolorized looks or fashionably faded looks in the fabric; (4) the dry ozone treatment processes of this invention reduce the amounts of suspended solids and chemical oxygen demand in wastewater as well as the volume of wastewater itself; (5) the dry ozone treatment processes of this invention can achieve aesthetically pleasing decolorized looks or fashionably faded looks in t-shirts even with reactive dyeing; (6) the dry ozone treatment processes of this invention use less energy, water, labor, and process time than conventional methods using stones or bleaches; (7) the dry ozone treatment processes of this invention use less bleaches, harmful chemicals or potassium permanganate; and (8) the water used for ozone decolorization is much easier to recycle than waste water from the conventional methods.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Figure 1:
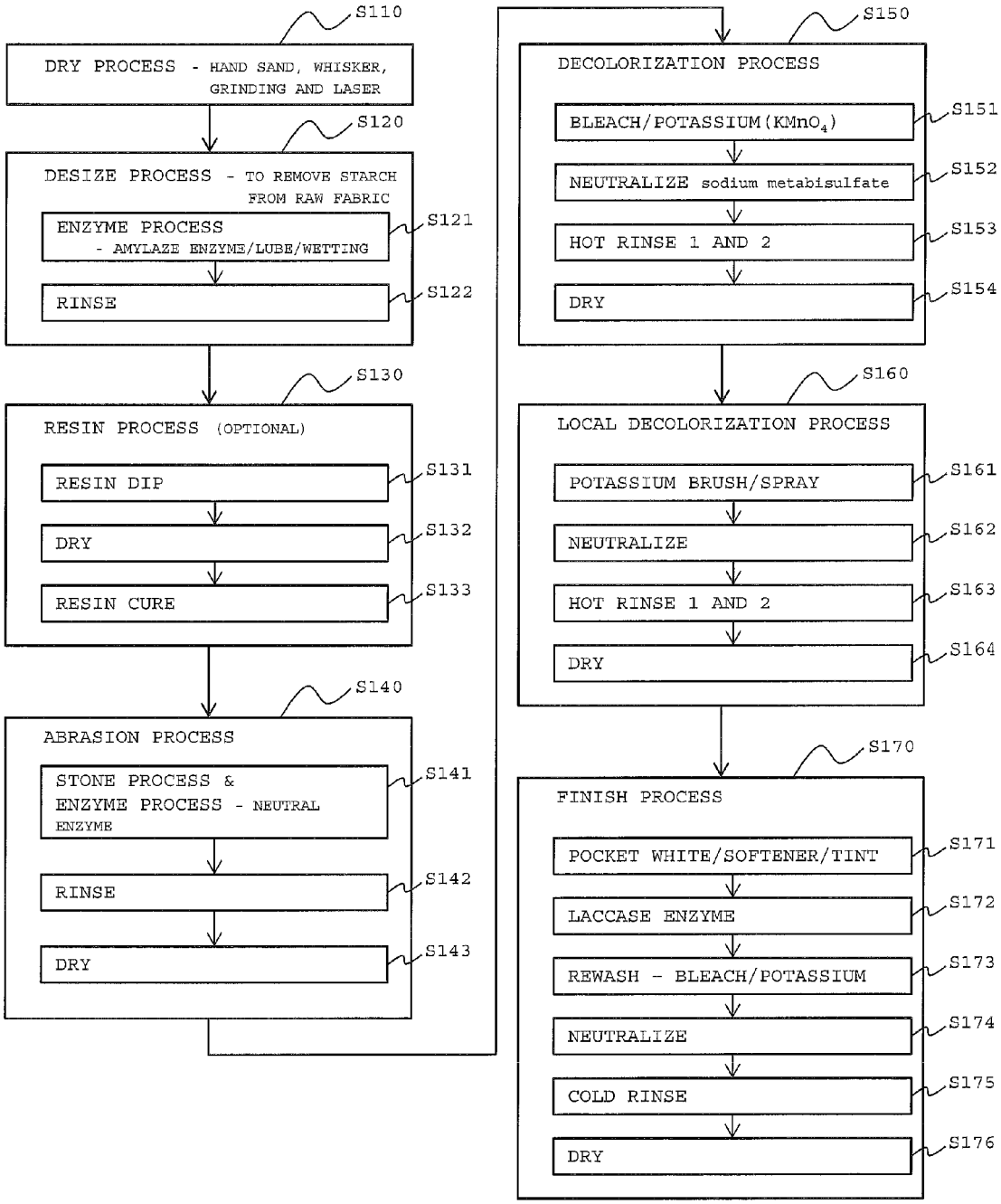
FIG. 1 Prior Art
FIG. 1 is a flow chart showing a conventional fabric decolorization method.
Figure 2:
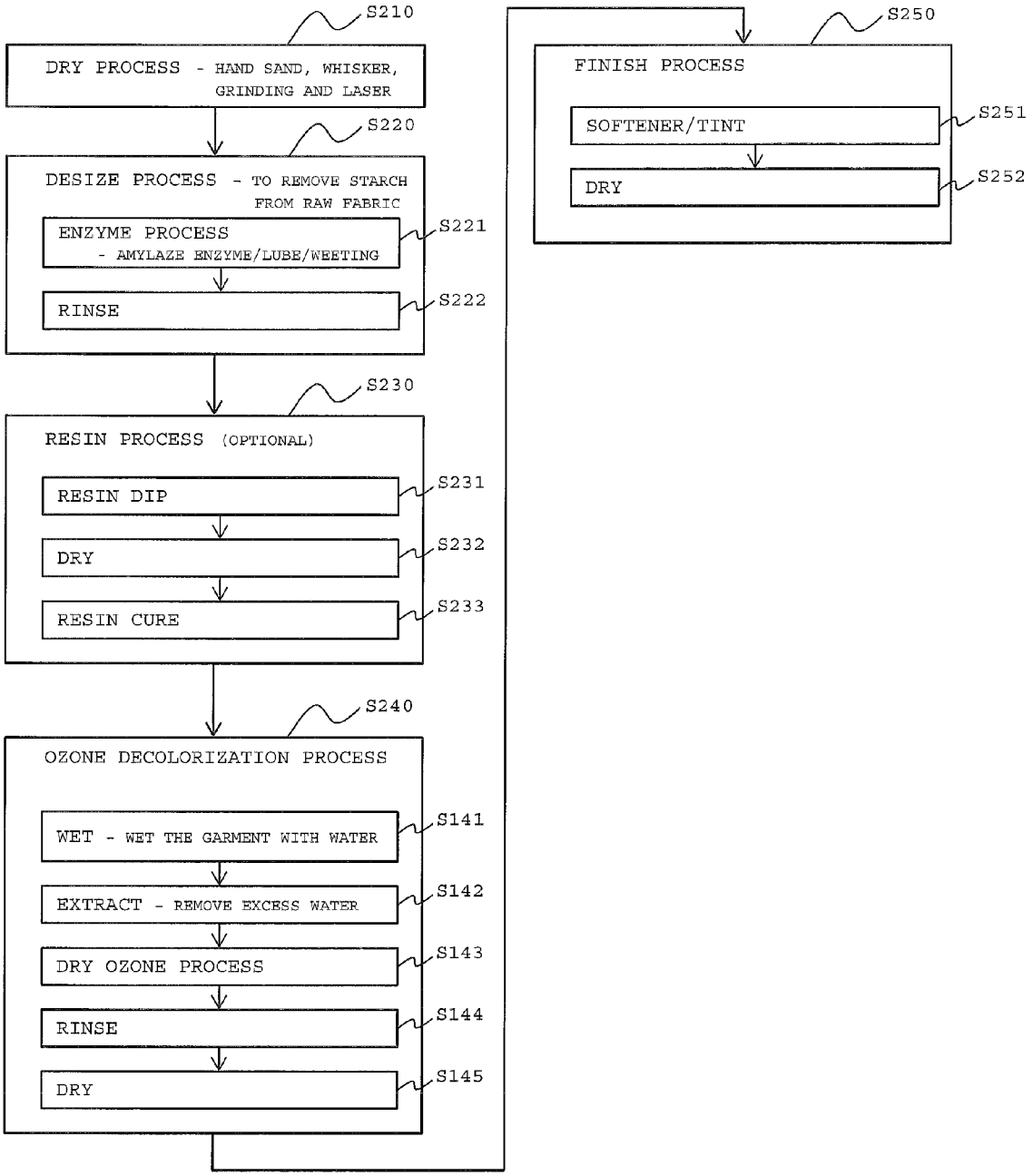
FIG. 2 is a flow chart showing the dry ozone treatment method of the present invention.

FIG. 2 shows the dry ozone treatment method of the present invention using the first dry ozone treatment process. Unlike the conventional fabric decolorization method having three separate processes of abrasion process S140, decolorization process S150 and local decolorization process S160, the present method has only one ozone treatment process S240. Furthermore, the finish process S250 has become a lot simpler. Especially, pocket white does not have to be used in the method of this invention.

There are three dry ozone treatment processes for the ozone decolorization process S240 of FIG. 2 and the three processes may be used alone or in any combination thereof for decolorizing a dyed fabric to obtain an aesthetically pleasing decolorized look or fashionably faded look in the fabric.

The first dry ozone treatment process includes wetting a textile product with water, removing excess water from the water-soaked textile product, and exposing the textile product to the ozone gas for decolorizing the textile product. The second dry ozone treatment process includes spraying water to desired areas of the textile product and exposing the textile product to ozone gas to decolorize the textile product. Lastly, the third dry ozone treatment process includes loading the textile product and cotton fabric scraps into a drum wherein the cotton fabric scraps are wetted with water, supplying and stirring ozone gas inside the drum, and rotating the air-tight drum. The three dry ozone treatment processes may be applied alone or in any combination thereof.

The three dry ozone treatment processes dispense with the need to use stones and bleaches such as pumice stones or potassium permanganate. With the three processes in use, stone washing, bleach washing and bleach spraying processes are not necessary, but the same or better decolorized look or faded look of garments can be achieved by using ozone gas. Furthermore, pocket white does not have to be used either because there is less concern for backstaining.

The first dry ozone treatment process includes wetting a textile product with water and thus, the process is not selective. Thus, just like bleach washing, the whole wetted textile product is oxidized.

The second dry ozone treatment process includes spraying water to desired areas of the textile product and thus, only those desired areas are oxidized. This process can achieve the effect of bleach spraying.

The third dry ozone treatment process includes adding wetted cotton fabric scraps to dry garments. While the scraps and garments are rotated inside a drum, the scraps provide water to random areas of the garments and the areas are oxidized. This process can achieve the effect of stone washing.

Preferably, star fish patterns were achieved on the surface of the textile product when all of the cotton fabric scraps is about or smaller than 25 square inches, the weight ratio of the cotton fabric scraps to water is about 1.0:0.5~1.5, and the weight ratio of the textile product to the cotton fabric scraps is about 1.0:0.2~1.0. The ozone treatment is performed for up to one hour.

Figure 3:
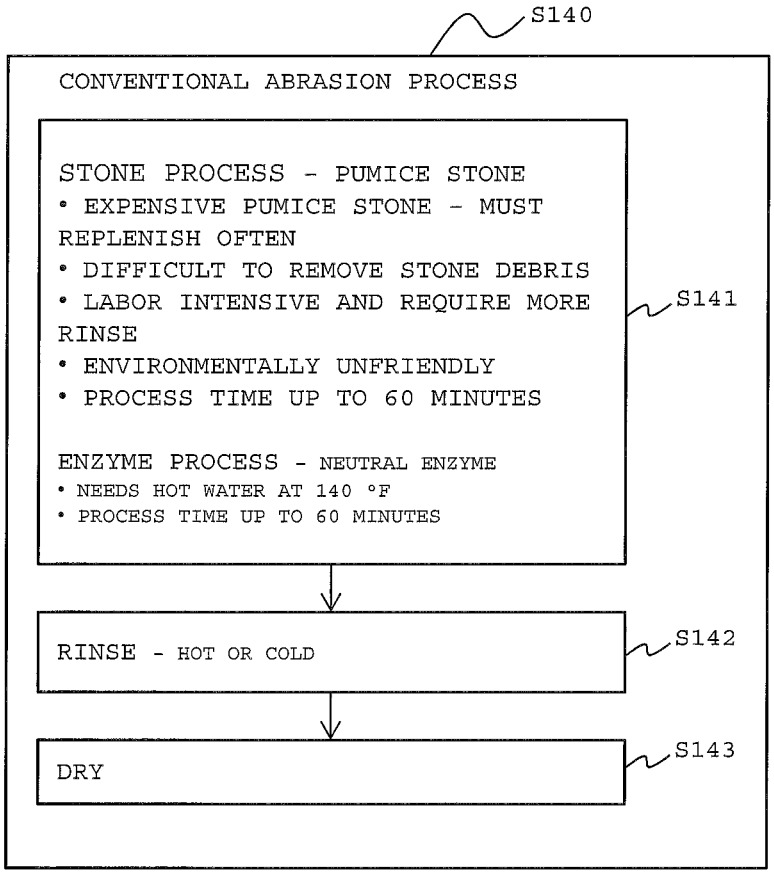
FIG. 3 Prior Art
FIG. 3 is a flow chart showing the conventional abrasion process.
Figure 4:
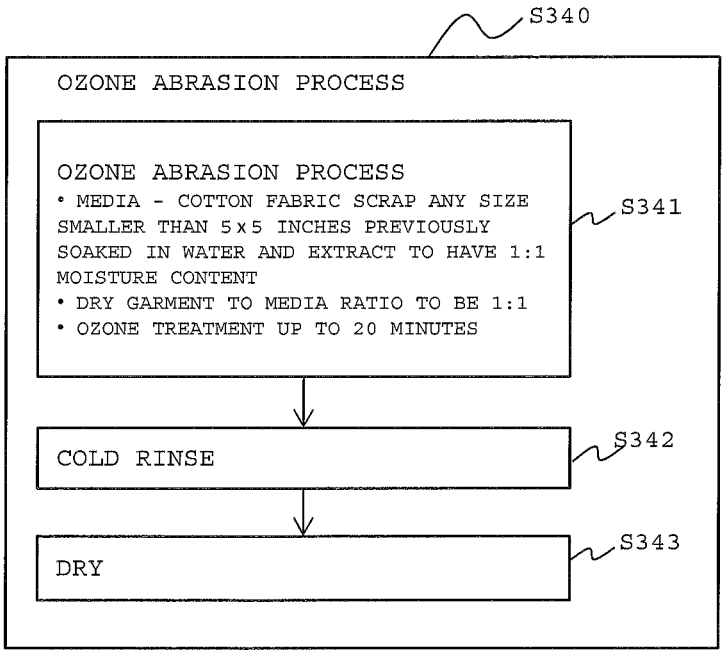
FIG. 4 is a flow chart showing the ozone abrasion process of the present invention.

FIG. 3 shows a conventional abrasion process S140 and FIG. 4 shows the ozone abrasion process S340 of the present invention which is one example of the third dry ozone treatment process. The ozone abrasion process may be applied to a fabric, denim fabric or t-shirts. If applied to t-shirts, stylish decoloration was achieved even if the t-shirts were dyed with reactive dyeing.

The ozone decolorizing method of the present invention comprises a dry process for manually treating a textile product; a desize process for removing starch from the textile product; a step of wetting the textile product with water and removing excess water from the water-soaked textile product; a step of exposing the textile product to ozone gas for decolorizing the textile product; and a step of washing the textile product with water and dehydrating the textile product. The step of exposing the textile product to ozone gas may further comprise a step of loading the textile product into a drum; a step of supplying and stirring ozone gas inside the drum; and a step of rotating the air-tight drum.

Additionally, cotton fabric scraps may be loaded into the drum before the step of supplying and stirring ozone gas inside the drum wherein the cotton fabric scraps are wetted with water. Preferably, all of the cotton fabric scraps may be about or smaller than 25 square inches. The weight ratio of the cotton fabric scraps to water may be about 1.0:0.5~1.5 and the weight ratio of the textile product to the cotton fabric scraps may be about 1.0:0.2~1.0. Moreover, the ozone treatment may be performed for up to one hour.

Besides, the textile product may be denim or t-shirts.

Another ozone decolorization method of the present invention comprises a dry process for manually treating a textile product; a desize process for removing starch from the textile product; spraying water to desired areas of the textile product; exposing the textile product to ozone gas to decolorize the textile product; rinsing the textile product; and drying the textile product.

Before the step of supplying and stirring ozone gas inside the drum, wetted cotton fabric scraps may be loaded into the drum.

Still another ozone decolorization method of the present invention comprises a step of loading the textile product and cotton fabric scraps into a drum wherein the cotton fabric scraps are wetted with water; a step of supplying and stirring ozone gas inside the drum; a step of rotating the air-tight drum; and a step of washing the textile product with water and dehydrating the textile product. Here, if the textile product is t-shirts, the desize process is not necessary.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A Method for decolorizing a textile product, comprising:

a dry process for manually treating a textile product;

a desize process removing Starch from the textile Product;

a step of wetting the textile product With water and removing excess water from the water-soaked textile product;

a step of exposing the textile product to ozone gas for decoorizing the textile product; and step of washing the textile product with water and dehydrating the textile Product, wherein the step of exposing the textile product to ozone gas comprises:

a step of loading the textile product and cotton fabric scraps into an air-tight drum wherein the cotton fabric scraps are wetted with water;

a step of supplying and stirring ozone gas inside the drum; and a step of rotating the air-tight drum so that the cotton fabric scraps can provide water to various parts of the textile product and that the ozone as decolorizes the textile product.

2. The method for decolorizing a textile product of claim 1, wherein the cotton fabric scraps are about or smaller than 25 square inches.

3. The method for decolorizing a textile product of claim 1, wherein the weight ratio of the cotton fabric scraps to water is about 1.0:0.~1.5 and the weight ratio of the textile product to the cotton fabric scraps is about 1.0:0.2~1.0.

4. The method for decolorizing a textile product of claim 1, wherein the ozone treatment is performed for up to one hour.

5. The method for decolorizing a textile product of claim 1 wherein the method for decolorizing a textile product does not use bleach to oxidize the textile product.

6. The method for decolorizing a textile product of claim 1 wherein the method for decolorizing a textile product does not use $KMnO_4$.

7. The method for decolorizing a textile plroduct of claim 1 wherein the method for decolorizing a textile product does not use pocket white.

8. The method for decolorizing a textile product of claim 1 Wherein the textile product is denim.

* * * * *